US008251641B2

(12) United States Patent
Hsu

(10) Patent No.: US 8,251,641 B2
(45) Date of Patent: Aug. 28, 2012

(54) STACK OF FAN CASE

(75) Inventor: Chia-Hao Hsu, Pingtung (TW)

(73) Assignee: ADDA Corporation, Pingtung, Pingtung (TW)

( * ) Notice: Subject to any disclaimer, the term of this patent is extended or adjusted under 35 U.S.C. 154(b) by 1171 days.

(21) Appl. No.: 12/078,454

(22) Filed: Mar. 31, 2008

(65) Prior Publication Data

US 2009/0246015 A1 Oct. 1, 2009

(51) Int. Cl.
*F04D 29/64* (2006.01)

(52) U.S. Cl. ..... 415/68; 415/213.1

(58) Field of Classification Search ..... 415/126, 415/127, 68, 220, 214.1, 213.1
See application file for complete search history.

(56) References Cited

U.S. PATENT DOCUMENTS 7,654,792 B2 * 2/2010 Kikuichi et al. ..... 415/68

* cited by examiner

*Primary Examiner* — Edward Look
*Assistant Examiner* — Jesse Prager
(74) *Attorney, Agent, or Firm* — Muncy, Geissler, Olds & Lowe, PLLC

(57) ABSTRACT

A stack of fan case in accordance with the present invention includes a first casing and a second casing stacked on the first casing. The first casing has a first surface, a second surface and a locking surface opposite to the second surface. An insertion bore formed on the second surface has an alignment bore, a fastening bore communicating to the alignment bore and a limit bump formed at the fastening bore. The second casing has a third surface, a fourth surface and at least one fastening member protruding on the fourth surface. The fastening member of the second casing is inserted into the alignment bore of the insertion bore to protrude on the locking surface of the first casing, and then casings are turned to make the fastening member pass through the limit bump and be accommodated within the fastening bore.

6 Claims, 9 Drawing Sheets

STACK OF FAN CASE

FIELD OF THE INVENTION

The present invention is generally relating to a stack of fan case, and more particularly to a stack of fan case having limit bump.

BACKGROUND OF THE INVENTION

As shown in FIGS. 1, 2, 3 and 4, conventional contrarotation type axial fan has a casing assembly structure including a first casing 110 and a second casing 120. The first casing 110 has a first surface 111 forming a plurality of first insertion grooves 112 and a plurality of second insertion grooves 113 thereon. The second insertion grooves 113 are located adjacent to the first insertion grooves 112 and extend to form a projective moving groove 113*a*. Each of the first insertion grooves 112 has a clasp-passing bore 112*a* and a clasp-moving bore 112*b*. The second casing 120 has a second surface 121 forming a plurality of clasps 122 and a plurality of protrusions 123 thereon. While assembling the first and second casings 110, 120, the clasps 122 of the second casing 120 are aligned with and inserted into the clasp-passing bores 112*a* of the first insertion grooves 112 on the first casing 110 and accommodated within the clasp-moving bores 112*b* of the first insertion grooves 112, which prevents the first and second casings 110, 120 from separation. Also, the protrusions 123 of the second casing 120 are accommodated within the projective moving grooves 113*a* of the second insertion grooves 113 for preventing the clasps 122 of the second casing 120 from slipping off the clasp-moving bores 112*b*. Accordingly, because it is necessary to form the second insertion grooves 113 and the projective moving grooves 113*a* on the first casing 110 and the protrusions 123 on the second casing 120, and align the protrusions 123 with the second insertion grooves 113 and the projective moving grooves 113*a*, mold-designing process becomes complicated and difficult.

SUMMARY

The primary object of the present invention is to provide a stack of fan case, which includes a first casing and a second casing. The first casing has a first surface, a second surface and a locking surface opposite to the second surface. An insertion bore formed on the second surface penetrates the second surface and the locking surface and has an alignment bore, a fastening bore communicating to the alignment bore and a limit bump formed at the fastening bore. The second casing has a third surface, a fourth surface and at least one fastening member protruding on the fourth surface. The fastening member including a stick-like portion and a limit clasp portion formed at one end of the stick-like portion is inserted into the alignment bore and then locks with the fastening bore. Wherein the stick-like portion of the fastening member is limited by the limit bump within the fastening bore, the limit clasp portion protrudes on and contacts against the locking surface of the first casing, which allows the fastening member not to slip off the fastening bore causing a separation of the first and second casings due to the limit bump that makes the stick-like portion of the fastening member be limited by the fastening bore. In addition, the present invention not only overcomes the problem of known technique about aligning the protrusions with the projective moving grooves of the second insertion, but also omits disposition of the known second insertion grooves, the projective moving grooves and the protrusions as to cost down.

DETAILED DESCRIPTION OF THE PRESENT INVENTION

Figure 1:
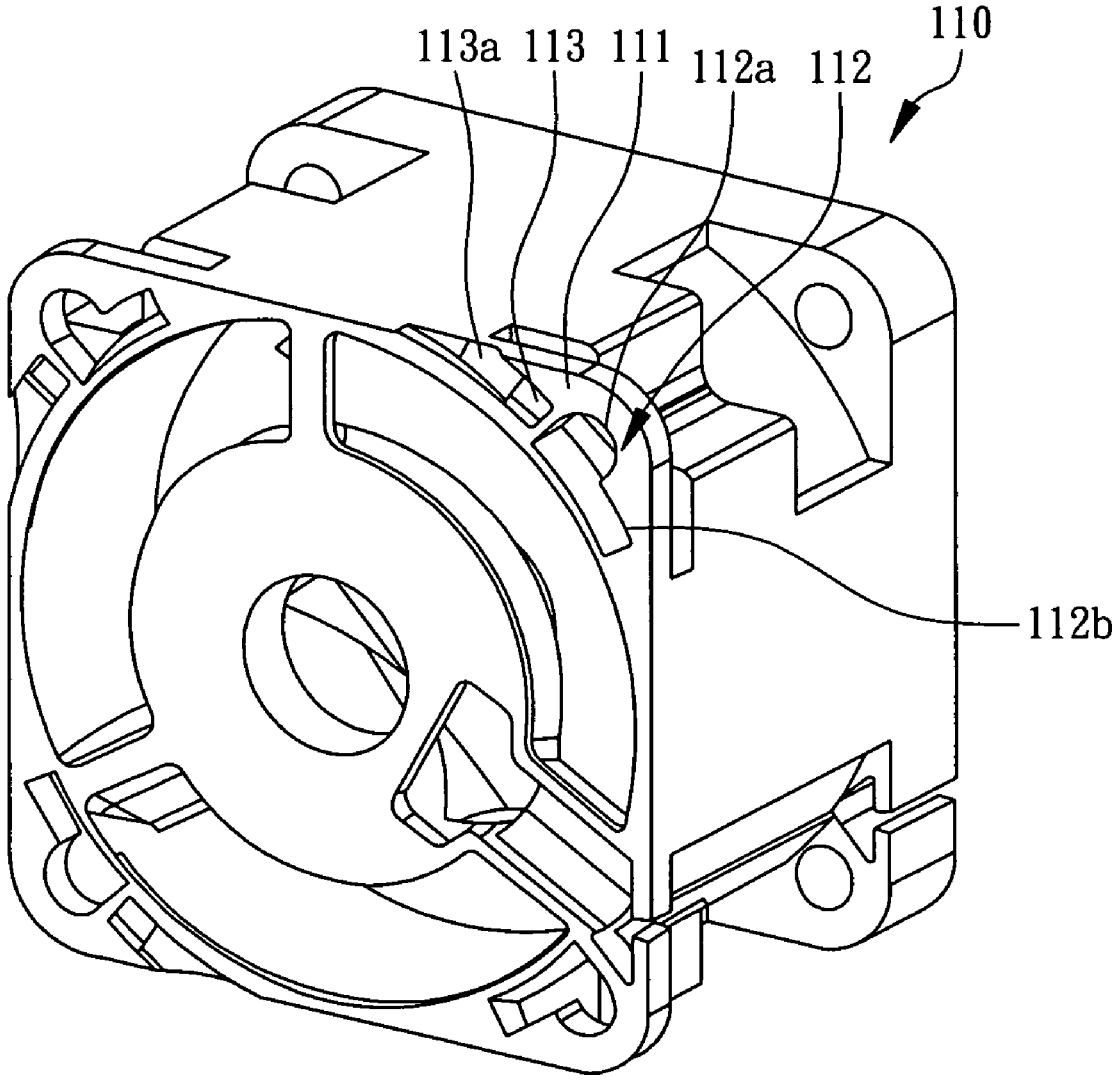
FIG. 1 PRIOR ART
FIG. 1 is a perspective view showing the first casing of a known fan.
Figure 2:
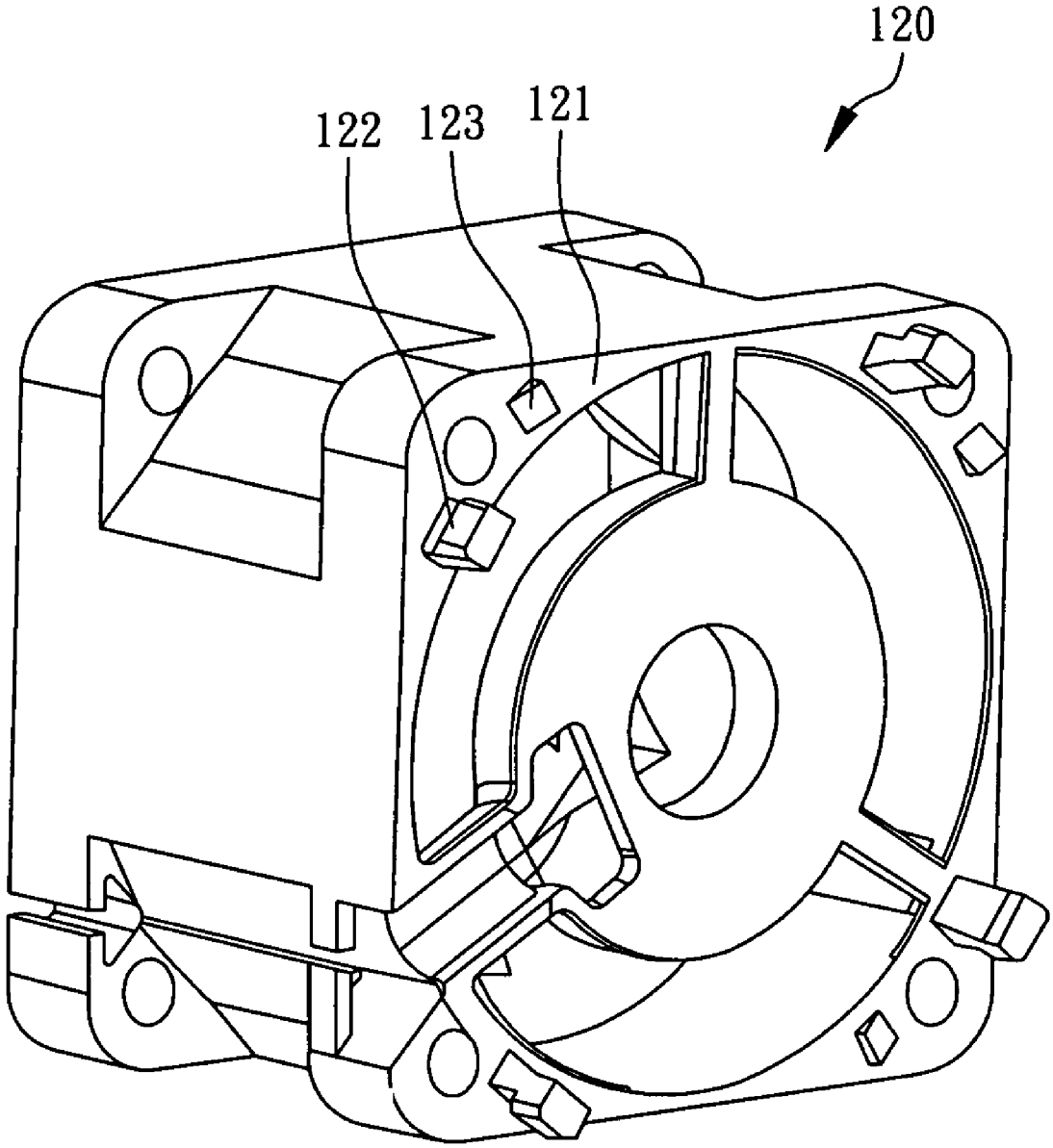
FIG. 2 PRIOR ART
FIG. 2 is a perspective view showing the second casing of a known fan.
Figure 3:
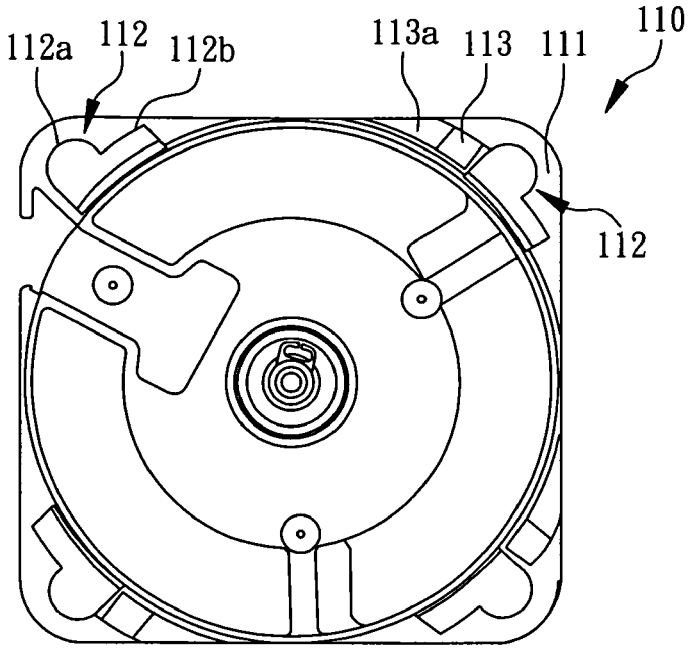
FIG. 3 PRIOR ART
FIG. 3 is a top view showing the first casing of a known fan.
Figure 4:
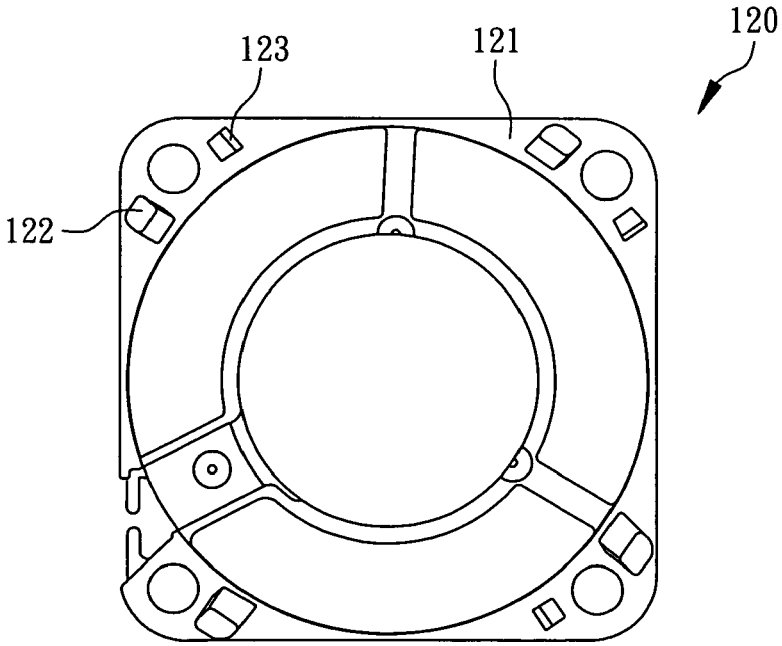
FIG. 4 PRIOR ART
FIG. 4 is a top view showing the second casing of a known fan.
Figure 5:
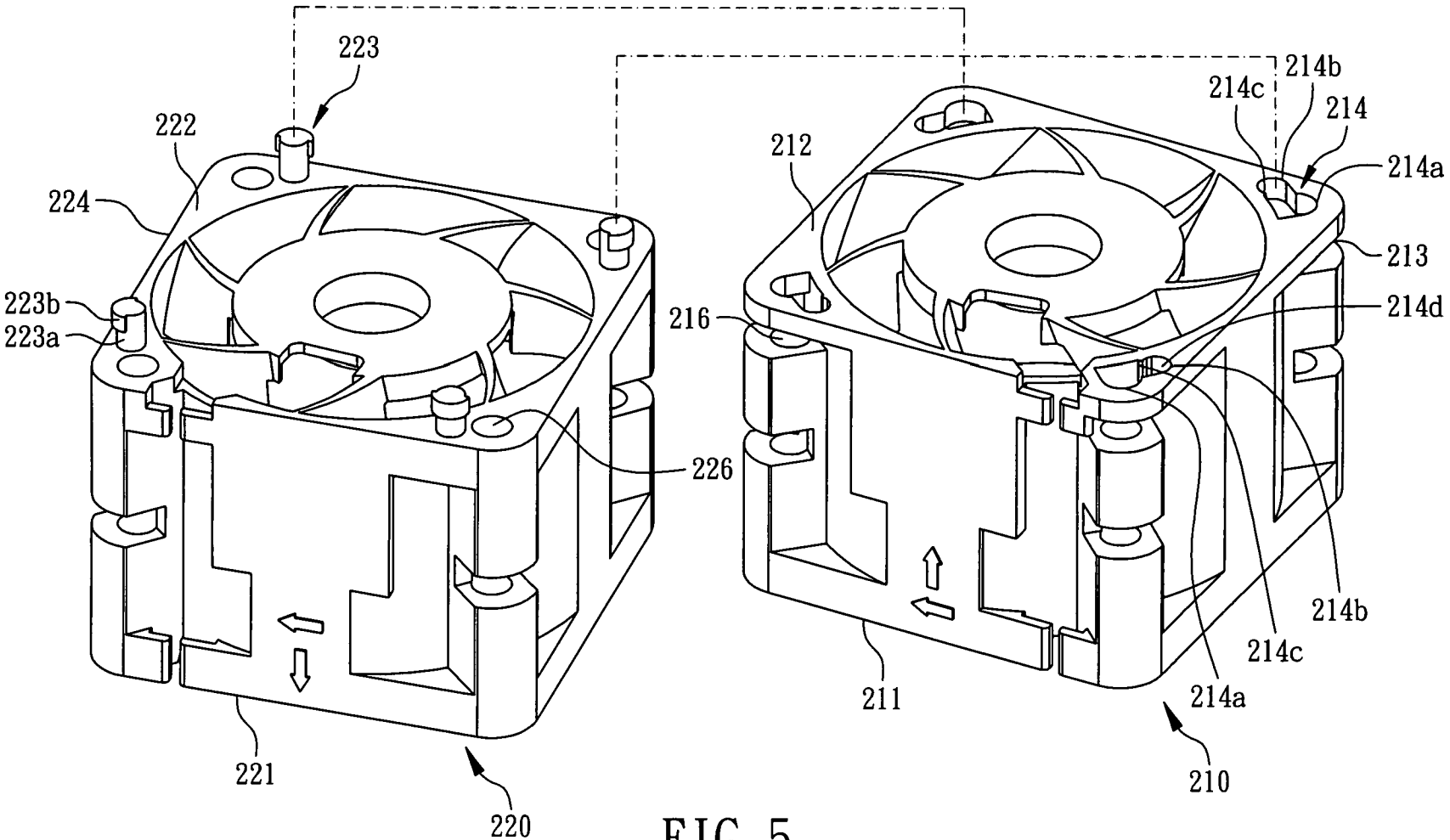
FIG. 5 is a perspective view showing the first and second casings of a stack of fan case in accordance with an embodiment of the present invention.
Figure 6:
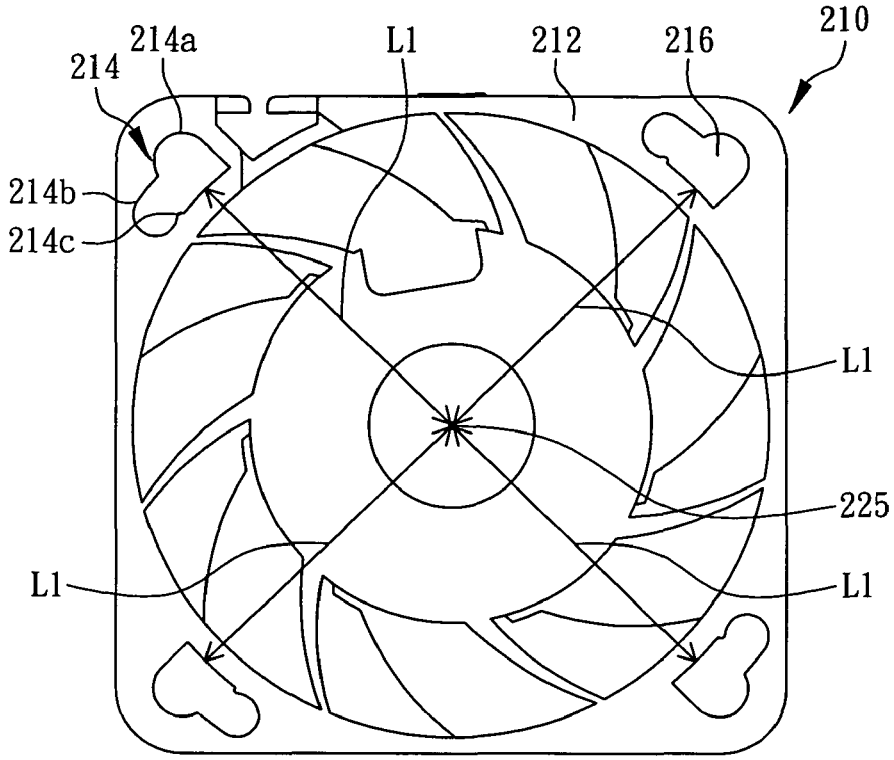
FIG. 6 is a top view showing the first casing of the stack of fan case in accordance with an embodiment of the present invention.
Figure 7:
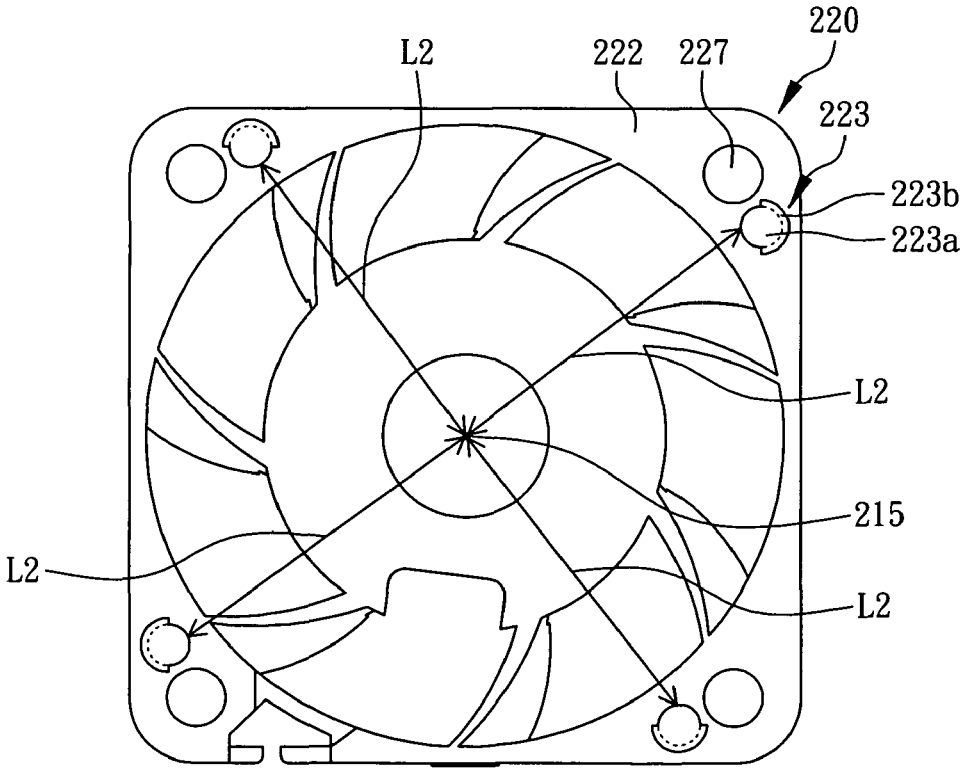
FIG. 7 is a top view showing the second casing of the stack of fan case in accordance with an embodiment of the present invention.
Figure 8:
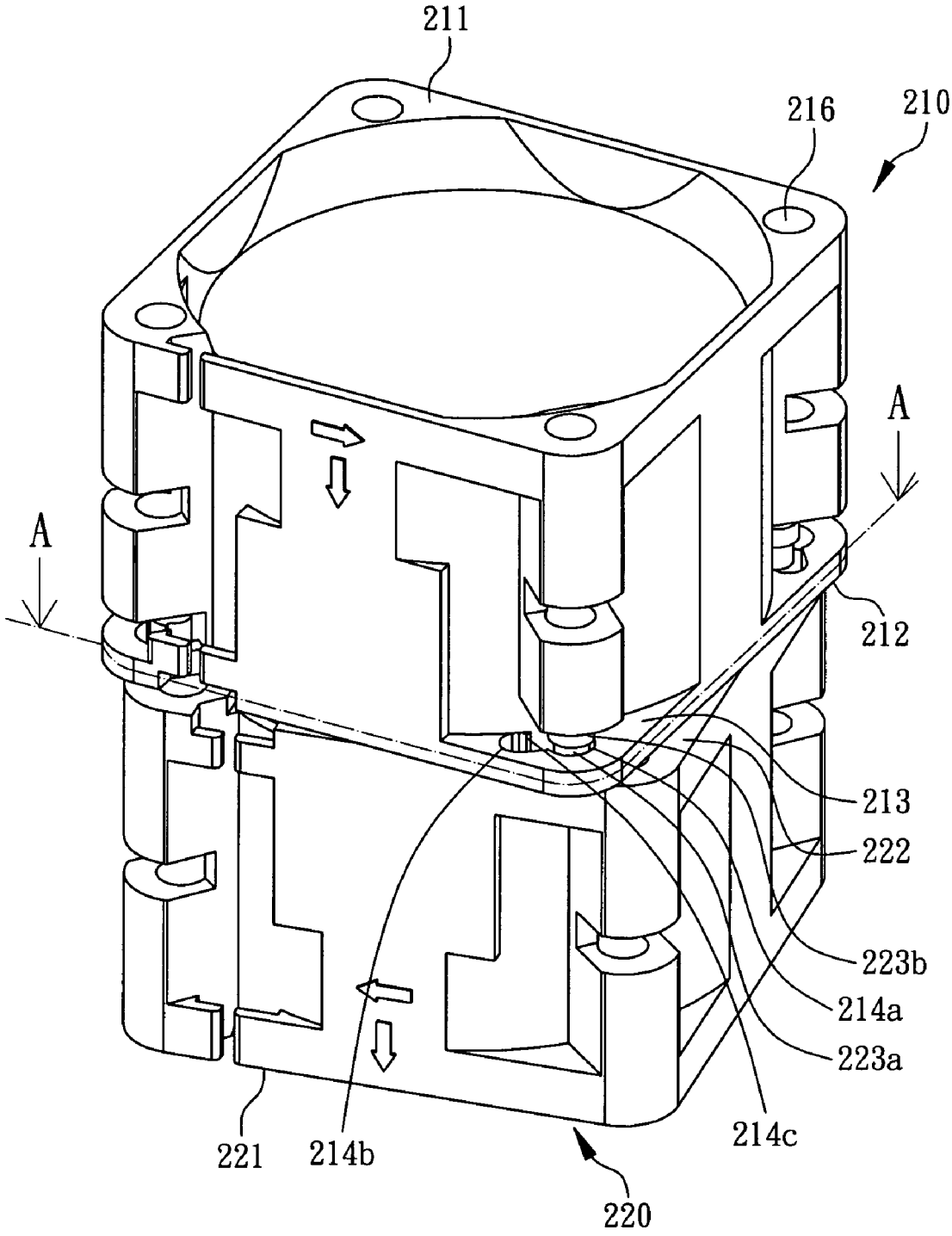
FIG. 8 is a perspective view showing the fastening member of the stack of fan case is inserted into the alignment bore of the insertion bore in accordance with an embodiment of the present invention.
Figure 9:
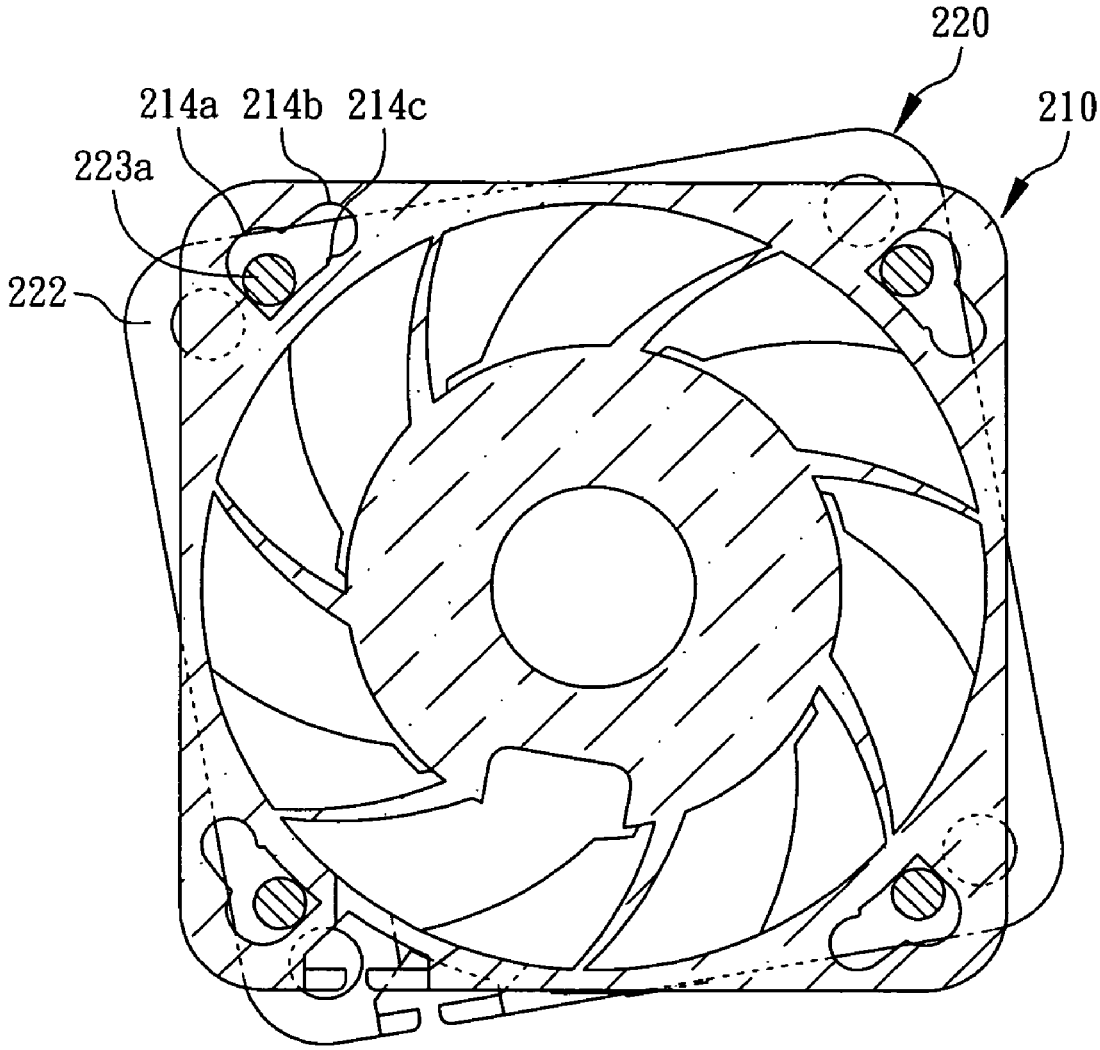
FIG. 9 is a cross-sectional view along A-A line of FIG. 8 showing the fastening member of the stack of fan case is inserted into the alignment bore of the insertion bore in accordance with an embodiment of the present invention.
Figure 10:
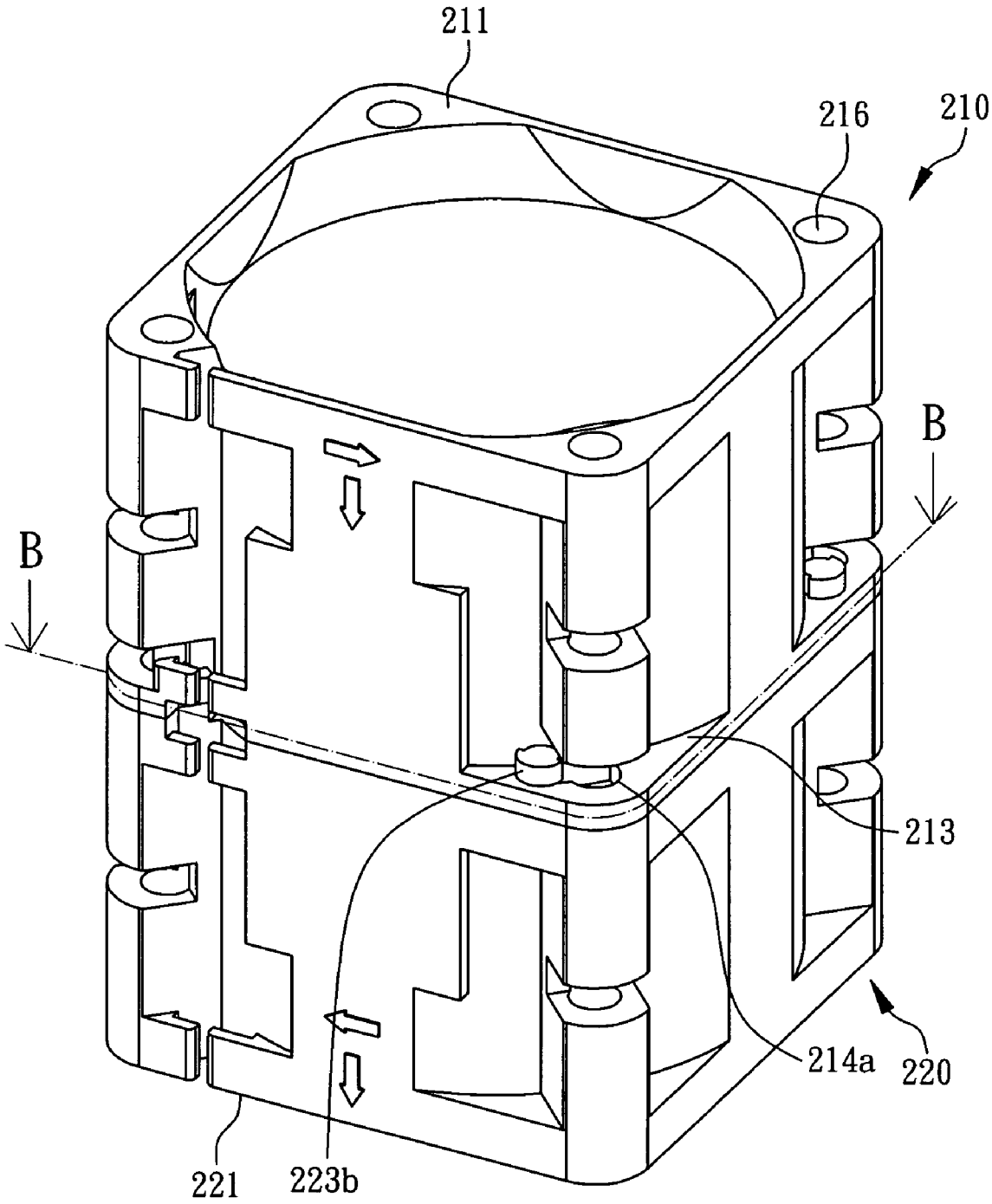
FIG. 10 is a perspective view showing the fastening member of the stack of fan case is inserted into the alignment bore of the insertion bore and the second casing is turned to lock the fastening member with the fastening bore in accordance with an embodiment of the present invention.
Figure 11:
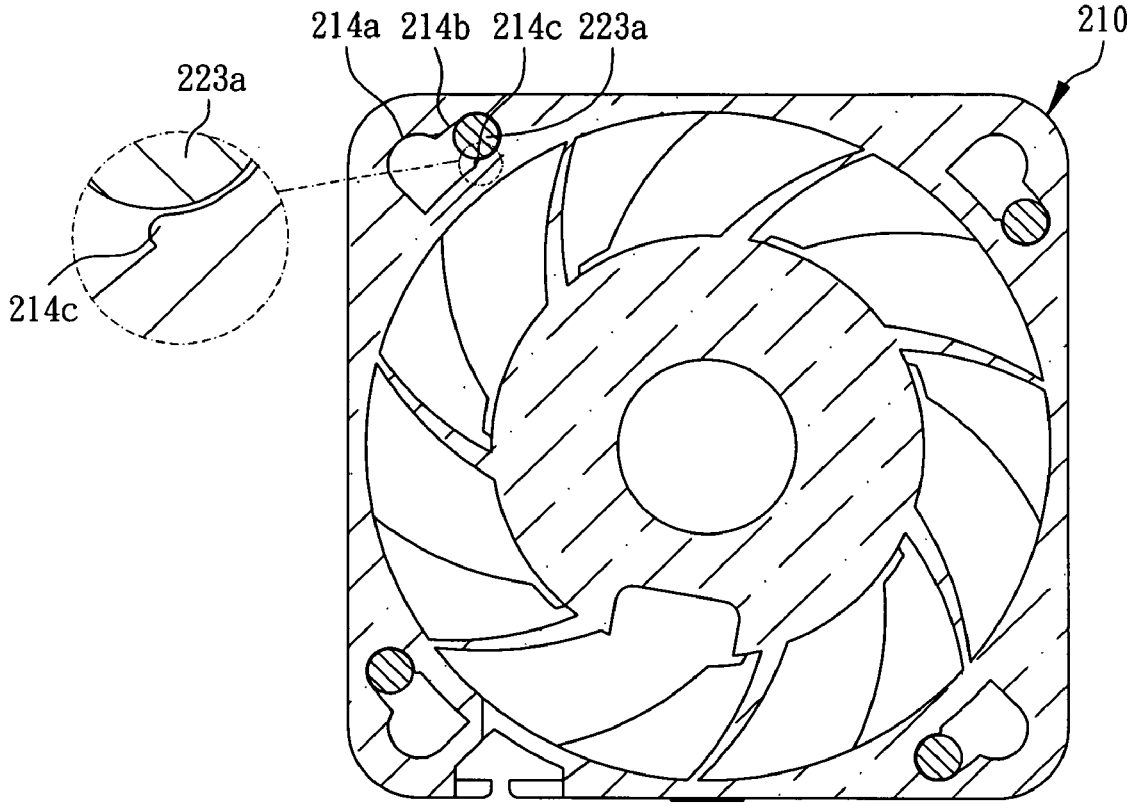
FIG. 11 is a cross-sectional view along B-B line of FIG. 10 showing the fastening member of the stack of fan case is inserted into the alignment bore of the insertion bore and the second casing is turned to lock the fastening member with the fastening bore in accordance with an embodiment of the present invention.

According to an embodiment of the present invention a stack of fan case is disclosed shown in FIGS. 5, 6 and 7 including a first casing 210 and a second casing 220. As shown in FIGS. 5 and 6, the first casing 210 has a first surface 211, a second surface 212 and a locking surface 213 opposite to the second surface 212. An insertion bore 214 formed on the second surface 212 penetrates the second surface 212 and the locking surface 213 and has an alignment bore 214*a*, a fastening bore 214*b* communicating to the alignment bore 214*a* and a limit bump 214*c* formed at the fastening bore 214*b*. FIGS. 5 and 7 show the second casing 220 having a third surface 221, a fourth surface 222, at last a fastening member 223 protruding on the fourth surface 222 and at least one lateral 224, wherein the fastening member 223 includes a stick-like portion 223*a* and a limit clasp portion 223*b* formed at one end of the stick-like portion 223*a*. In this embodiment, in order to improve joint strength of the first and second casings 210, 220, there are a plurality of fastening members 223 and a plurality of insertion bores 214 formed on the second casing 220 and the second surface 212 of the first casing 210 respectively. FIGS. 8 and 10 show joint action of the first and second casings 210, 220, FIGS. 9 and 11 are cross-sectional view showing joint action of the first and second casings 210, 220. The second casing 220 is stacked on the first casing 210 shown in FIGS. 8 and 9, the fourth surface 222 of the second casing 220 faces the second surface 212 of the first casing 210, and then the fastening members 223 are inserted into the alignment bores 214*a* of the insertion bores 214, wherein the limit clasp portions 223*b* of the fastening members 223 protrude on the locking surface 213 of the first casing 210 and there is a displacement difference between the first and second casings 210, 220. Next, the first and second casing 210, 220 alone may be turned shown in FIG. 10, 11, or the first and second casings 210, 220 are simultaneously turned that allows the stick-like portion 223*a* of the fastening members 223 to pass through the limit bump 214*c* and be accommodated within the fastening bore 214*b*, wherein the stick-like portion 223*a* of the fastening members 223 is limited by the limit bump 214*c* within the fastening bore 214*b* capable of preventing the fastening members 223 from slipping off the fastening bore 214*b* causing a separation between the first and second casings 210, 220. The limit clasp portion 223*b* protrudes on the locking surface 213 of the first casing 210 and preferably contacts against the locking surface 213 as to avoid separation of the first and second casings 210, 220. In this embodiment referring back to FIG. 5, each of the fastening bores 214*b* has an inner wall 214*d* and the limit bumps 214*c* are formed and protrude on the inner wall 214*d* of the fastening bores 214*b*, so that the fastening members 223 may be limited by the limit bumps 214*c* within the fastening bores 214*b*. Besides, the limit clasp portions 223*b* of the fastening members 223 face the lateral 224 and contact against the locking surface 213 of the first casing 210 able to increase axial and radial joint strength of the first and second casings 210,220. Accordingly, the present invention applies the limit bumps 214*c* for locking the fastening members 223 to be limited within the fastening bores 214*b* thereby omitting disposition and alignment of the known second insertion grooves and the protrusions, and mold-designing process also can be saved.

In addition, in this embodiment referring again to FIG. 5, 6, 7, the first casing 210 further has a first central 215 and at least one first through hole 216, wherein the linear distances L1 between the first central 215 and each of the insertion bores 214 are typically same, the first through hole 216 penetrates the first casing 210 and is aligned with the alignment bore 214*a* of the insertion bore 214. The second casing 220 further has a second central 225 and at least one second through hole 226, wherein the linear distances L2 between the second central 225 and each of the fastening members 223 are typically same, the second through hole 226 penetrates the second casing 220 and is adjacent to the fastening members 223. The first and second through holes 216, 226 dispose screws applied by the first and second casings 210, 220 for joining with other components (not illustrated).

While the present invention has been particularly illustrated and described in detail with respect to the preferred embodiments thereof, it will be clearly understood by those skilled in the art that various changed in form and details may be made without departing from the spirit and scope of the present invention.

What is claimed is:

1. A stack of fan case comprising a first casing having a first surface, a second surface and a locking surface opposite to the second surface, wherein an insertion bore formed on the second surface penetrates the second surface and the locking surface and has an alignment bore, a fastening bore communicating to the alignment bore and a limit bump formed at the fastening bore; and a second casing stacked on the first casing and having a third surface, a fourth surface and at least one fastening member protruding on the fourth surface, wherein the fastening member includes a stick-like portion and a limit clasp portion and is inserted into the insertion bore, the stick-like portion of the fastening member is limited by the limit bump within the fastening bore, and the limit clasp portion protrudes on the locking surface of the first casing.

2. The stack of fan case in accordance with claim 1, wherein the fastening bore has an inner wall and the limit bump is formed on the inner wall of the fastening bore.

3. The stack of fan case in accordance with claim 1, wherein the limit clasp portion contacts against the locking surface of the first casing.

4. The stack of fan case in accordance with claim 1, wherein the second casing further has at least one lateral and the limit clasp portion of the fastening member faces the lateral.

5. The stack of fan case in accordance with claim 1, wherein the first casing further has at least one first through hole, the first through hole penetrates the first casing and is aligned with the alignment bore of the insertion bore.

6. The stack of fan case in accordance with claim 1, wherein the second casing further has at least one second through hole, the second through hole penetrates the second casing and is adjacent to the fastening member.

* * * * *